United States Patent [19]

Strobel

[11] Patent Number: 4,701,967

[45] Date of Patent: Oct. 27, 1987

[54] HYDRAULIC UNIT FOR WATERBED, AND METHOD OF FORMING

[76] Inventor: Mark J. Strobel, 3131 Industrial Pkwy., Jeffersonville, Ind. 47130

[21] Appl. No.: 869,312

[22] Filed: Jun. 2, 1986

[51] Int. Cl.[4] ..... A47C 27/08; B32B 27/36; B32B 31/20

[52] U.S. Cl. ..... 5/450; 5/451; 156/62.2; 156/275.1; 156/292; 156/303.1; 156/308.4; 156/313; 428/238; 428/247; 428/252; 428/287

[58] Field of Search ..... 5/450, 451; 156/62.2, 156/275.1, 292, 303.1, 308.4, 380.6, 313, 62.8; 428/236, 238, 239, 246, 247, 252, 287, 307.7, 318.6

[56] References Cited

U.S. PATENT DOCUMENTS 4,044,180 8/1977 Baker ..... 428/287
4,399,575 8/1983 Hall ..... 5/450
4,411,033 10/1983 Morgan ..... 5/450
4,517,691 5/1985 Phillips ..... 5/450

*Primary Examiner*—Donald E. Czaja
*Assistant Examiner*—Lori Cuervo
*Attorney, Agent, or Firm*—James B. Middleton

[57] ABSTRACT

A hydraulic unit for a waterbed mattress is provided, along with a method for constructing the unit. The usual lower sheet having a plurality of chambers is covered with the usual upper sheet, and the fibrous bat is placed over the upper sheet. The assembly can be welded together, and plastic from the lower and upper sheets encases the fibrous bat to hold the bat to the hydraulic unit. The upper sheet, which is normally thin, should have about the same thickness as the lower sheet to prevent degradation. Otherwise, the upper sheet can remain thin, and a porous sheet is interposed, so the plastic from the lower and upper sheets flows through the porous sheet and encases the fibrous bat without degrading the thin upper sheet.

5 Claims, 4 Drawing Figures

HYDRAULIC UNIT FOR WATERBED, AND METHOD OF FORMING

INFORMATION DISCLOSURE STATEMENT

In the waterbed industry, it is common practice to provide a hydraulic waterbed for the purpose of reducing wave motion. The general structure of the hydraulic waterbed is such that a plurality of generally closed chambers is provided inside the water mattress, the generally closed chambers having a plurality of discrete openings therein. The dynamic action is therefore the conventional shock absorber or dashpot action wherein liquid is forced to exit through discrete openings so that collapse of the enclosures is delayed by the fluid flow.

In providing these hydraulic structures, the enclosures generally float within the water mattress so that the hydraulic structure is adjacent to the upper surface, or sleeping surface, of the mattress. To render the upper surface more comfortable, it is then known to provide a fibrous bat between the hydraulic unit and the upper surface of the mattress. Further, it is known to utilize a bat of entangled fibers such as polyester fibers, and to disperse throughout this bat of fibers beads of an expanded plastic material, such as expanded polystyrene. With this arrangement, the fibrous bat both provides comfort for the upper surface of the mattress, and causes flotation of the bat. It is then known to attach the hydraulic unit to this floatable bat. The attaching means for attaching the hydraulic unit to the fibrous bat is frequently in the form of rivets or brads that are passed through the hydraulic unit, and through the fibrous bat. A piece of material to perform the function of a washer or the like is also frequently required on the upper surface of the fibrous bat. These rivets or brads must be provided throughout the surface area of the fibrous bat to be sure the hydraulic unit is floated throughout the mattress. Provision of these rivets or brads is therefore extremely expensive in that it is a separate manufacturing step. Alternatively, some manufacturers have stitched the fibrous bat to the hydraulic unit. Again, this is a separate manufacturing step, one that tends to be much slower than the usual manufacturing techniques in the waterbed industry.

SUMMARY OF THE INVENTION

This invention relates generally to watereds, and is more particularly concerned with a method for attaching a fibrous bat to a hydraulic unit for use in a waterbed.

The present invention provides for the formation of a hydraulic unit in a minimum number of manufacturing steps, and the entire sequence of steps is in keeping with conventional techniques in the waterbed industry for greater economy. A sheet of thermoplastic material is formed with a plurality of chambers, and a cover sheet is placed over the plurality of chambers. Above this cover sheet, there is a porous sheet having a relatively high melting point, and the fibrous bat is placed above the porous sheet. This combination is then heat sealed, using conventional radio frequency (RF) sealing equipment, so the entire unit is formed in one step. The thermoplastic material of the hydraulic unit melts and passes through the porous material, and engages the fibrous bat so that the entire assembly is held together by the material of the hydraulic unit.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
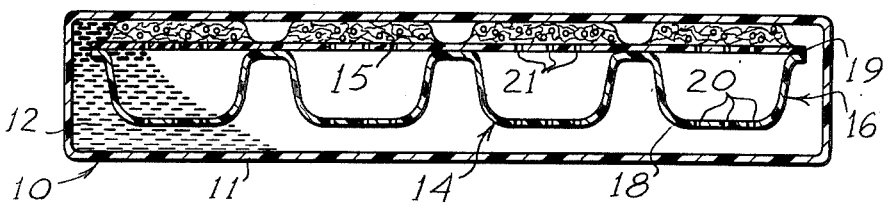
FIG. 1 is a transverse cross-sectional view through a hydraulic waterbed mattress made in accordance with the present invention.

Referring now more particularly to the drawings, and to that embodiment of the invention here presented by way of illustration, FIG. 1 shows a waterbed mattress generally indicated at 10 including the bladder 11 having an inner space 12 filled with water. Within the space 12, there is the hydraulic unit indicated at 14 having the fibrous bat 15 on the upper surface thereof.

It will be seen generally from FIG. 1 that the hydraulic unit 14 includes a lower member 16 having a plurality of chamber 18 formed therein. A coversheet 19 extends completely across the lower sheet 16 to enclose the chambers 18. The fibrous bat 15 is then fixed to the upper surface of the upper sheet 19. It will also be noted that there are holes 20 in the lower sheet 16, and holes 21 in the upper sheet 19. These holes 20 and 21 provide the shock absorber effect which yields the delayed motion sought.

Figure 2:
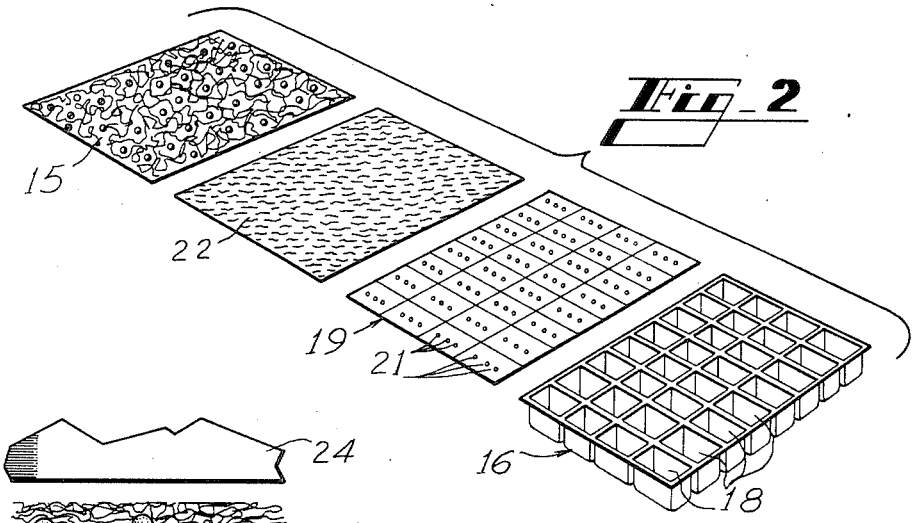
FIG. 2 is an exploded, perspective view showing the parts of the hydraulic unit illustrated in FIG. 1.

Looking at FIG. 2 of the drawings, it should be understood that formation of the lower member 16, and the covering of this member of the upper sheet 19 creates the basic hydraulic unit which is well known in the art. The lower sheet 16 may be vacuum formed to provide the individual chambers 18, or the individual chambers 18 may be fabricated to create the same result.

The upper sheet 19 is then placed over the lower sheet 16 to provide a plurality of substantially closed chambers 18. Again, whether the lower sheet 16 is vacuum formed or the arrangement is fabricated, the combination of the upper sheet 19 and the lower sheet 16 is known in the art.

While it is conventional to heat seal the sheet 19 to the lower sheet 16, it is generally not possible to heat seal the fibrous bat 15 in the same step. First, it must be understood that the hydraulic unit 14 is conventionally formed of polyvinylchloride sheet which will melt at a temperature in the vicinity of 170° C. while the fibrous bat 15 is conventionally formed of a polyester fiber, and the polyester fiber will conventionally melt at a temperature in the vicinity of 250° C. Thus, one cannot expect the fibrous bat 15 to be sealed into the hydraulic unit 14 in one easy step.

In attempting to seal the hydraulic unit 14 to the fibrous bat 15, since the melting temperatures are different, it was thought that the vinyl from the hydraulic unit could surround the polyester fibers of the fibrous unit 15, and this was found to be true. However, in using conventional materials, the materials were severely degraded so that the resulting assembly would come apart. More particularly, the lower sheet 16 is conventionally formed of 35 mil (0.9 mm) PVC sheet while the upper sheet 19 is conventionaly formed of 8 mil (0.2 mm) PVC. When the upper sheet 19 and the lower sheet 16 are heat sealed together, with the fibrous bat 15 placed over the sheet 19 to be sealed in the same operation, the upper sheet 19 is degraded to the point that the material is likely to come loose at most of the sealed seams. The obvious solution is then to increase the thickness of the upper sheet 19. It was found that, by increasing the thickness of the upper sheet 19 to 35 mil (0.9 mm) PVC, the fibrous bat 15, the upper sheet 19 and the lower sheet 16 can be heat sealed together, and the vinyl from the hydraulic unit 14 will encase the fibers in the fibrous bat 15.

While the thicker upper sheet 19 provides a durble and useful hydraulic unit, it will be understood that the use of the heavy vinyl tremendously increases the cost of the hydraulic unit. Because of this high cost, it is desirable to reduce the upper sheet 19 to the original, 8 mil (0.2 mm) thickness. It is for this reason that the porous sheet 22 is utilized.

While many different materials may be utilized for the porous sheet 22, it has been found that an 8 mil (0.2 mm) nonwoven polyester fabric can be used, and is quite successful.

Figure 3:
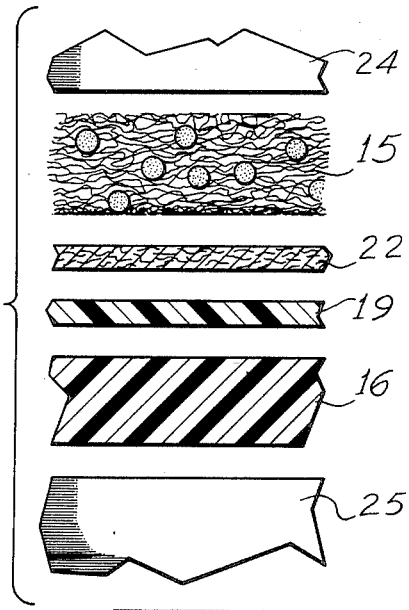
FIG. 3 is a fragmentary exploded view showing the plurality of sheets prior to sealing; and, FIG. 4 is a fragmentary view similar to FIG. 3 illustrating the material after heat sealing.

Looking at FIG. 3 of the drawings, the pieces of the assembly are shown fragmentarily and much enlarged. Also, the pieces of the assembly are shown between the clamping members of the RF sealing unit, the clamping members being indicated at 24 and 25 for the upper and lower clamp members respectively.

Those skilled in the art will understand that, conventionally, the lower sheet 16 will be placed on the RF sealing unit with metal bars extending along each line to be sealed, the metal bars being indicated in FIG. 3 at 25. With the lower sheet 16 in place, the upper sheet 19 will be placed directly on top of the lower sheet 16 and properly aligned. Next, the porous sheet 22 will be placed over the upper sheet 19; and, this will be followed by the placing of the fibrous bat 15 on top of the porous sheet 22. There is then an upper clamping member designated at 24 in FIG. 3 to clamp the assembly together. RF energy is propagated into the assembly to cause heating of the material, and melting of the vinyl.

Figure 4:
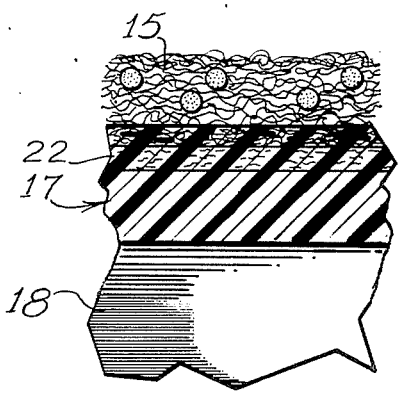

FIG. 4 is an illustration showing the assembly after heating, and it must be realized that the depiction cannot be accurate but should be informative. The vinyl is shown as a single piece, since the lower sheet 16 and the upper sheet 19 are truly welded together. The single piece is designated as 17 to avoid confusion.

Somewhat within the material 17 there is indicated the porous sheet 22. It will be understood that the vinyl of the sheet 16 and 19 will flow through the porous sheet 22 so that the porous sheet 22 will be completely within the vinyl material. Also, the fibrous bat 15 will have been urged into the vinyl material that flows through the porous sheet 22. It should therefore be understood that the vinyl material from the lower sheet 16 and upper sheet 19 will flow through and encase the porous sheet 22 and sealed portions of the fibrous bat 15.

In an effort to present a clear picture of a mechanism, it will be understood that the lower sheet is 35 mils (0.9 mm) thick, the upper sheet 19 is 8 mils (0.2 mm) thick, the porous sheet 22 is 8 mils (0.2 mm) thick, and the fibrous bat 15 is about 1.5 inches thick before sealing. When this assembly is pressed together between the members 24 and 25, and the assembly is heated, the final thickness of the material 17 is from about 40 to 50 mils (1–1.3 mm). It will therefore be understood that the vinyl completely encases the entire sealed area.

By utilizing the porous sheet 22 as discussed, it has been found that the 8 mil vinyl sheet 19 is not degraded, but a highly stable hydraulic unit 14 is provided. Furthermore, since one would generally have to seal the upper sheet 19 to the lower sheet 16 by a technique similar to that described herein, the use of the same step to attach the fibrous bat 15 at the same time is a considerable saving in time and energy.

It will of course be understood by those skilled in the art that the particular embodiment of the invention here presented is way of illustration only, and is meant to be in no way restrictive; therefore, numerous changes and modifications may be made, and the full use of equivalents resorted to, without departing from the spirit and the scope of the invention as outlined in the appended claims.

I claim:

1. A hydraulic unit for a waterbed, said hydraulic unit including a lower sheet having a plurality of chambers formed therein, an upper sheet coextensive with said lower sheet and closing said plurality of chambers, a fibrous bat above said upper sheet and generally coextensive therewith, said lower sheet and said upper sheet being formed of thermoplastic material, said thermoplastic material of said lower and said upper sheets being thermally welded together and having portions of said fibrous bat embedded therein for holding the entire assembly together, said fibrous bat being formed of a material having a higher melting temperature than said thermoplastic material of said lower and upper sheets, said upper sheet being thin relative to said lower sheet, and further including a porous sheet for preventing degradation of said upper sheet, said porous sheet being interposed between said upper sheet and said fibrous bat.

2. A hydraulic unit as claimed in claim 1, said lower sheet and said upper sheet being formed of polyvinylchloride, said fibrous bat being formed of polyester fiber, and said porous sheet being formed of non-woven polyester.

3. A hydraulic unit as claimed in claim 1, said lower sheet having a thickness around 35 mils, said upper sheet having a thickness around 8 mils.

4. A hydraulic unit as claimed in claim 1, said porous sheet having a thickness of about 8 mils.

5. A method for forming a hydraulic unit for a waterbed, wherein a lower sheet is formed with a plurality of chambers, an upper sheet is placed over said lower sheet to close said plurality of chambers, and a fibrous bat is placed over said upper sheet for providing comfort for the waterbed, said lower sheet and said upper sheet being formed of thermoplastic material, said fibrous bat being formed of a material having a melting point higher than said thermoplastic material of said lower and upper sheets, said method including the steps of placing said lower sheet into a welder, placing said upper sheet over said lower sheet and coextensive therewith, placing said fibrous bat over said upper sheet and coextensive therewith, clamping said lower sheet, said upper sheet and said fibrous bat together into a single assembly, heating said assembly sufficiently to cause said lower sheet and said upper sheet to weld together and to encase said fibrous bat within the weld, and further including the steps of using a thin upper sheet relative to said lower sheet, and placing a porous sheet between said upper sheet and said fibrous bat before the step of clamping the assembly together.

* * * * *